United States Patent [19]

Hada et al.

[11] Patent Number: 4,505,250

[45] Date of Patent: Mar. 19, 1985

[54] VARIABLE VENTURI CARBURETOR

[75] Inventors: Toshikatsu Hada, Aichi; Yukinori Isoya, Nagoya, both of Japan

[73] Assignee: Aisan Kogyo Kabushiki Kaisha, Japan

[21] Appl. No.: 469,533

[22] Filed: Feb. 24, 1983

[30] Foreign Application Priority Data

Mar. 23, 1982 [JP] Japan ..... 57-41591[U]

[51] Int. Cl.[3] ..... F02M 31/20

[52] U.S. Cl. ..... 123/540; 261/44 B; 261/41 D; 261/44 C

[58] Field of Search ..... 261/44 C, 44 B, DIG. 81, 261/41 D, 121 A; 123/543, 540

[56] References Cited

U.S. PATENT DOCUMENTS 2,062,496 12/1936 Brokel ..... 261/44 B

FOREIGN PATENT DOCUMENTS 747986 10/1944 Fed. Rep. of Germany .... 261/44 B
52-15932 2/1977 Japan ..... 261/44 B
488462 7/1938 United Kingdom ..... 261/44 B
663963 1/1952 United Kingdom ..... 261/44 B
1144405 3/1969 United Kingdom ..... 261/44 C

*Primary Examiner*—Ronald H. Lazarus
*Attorney, Agent, or Firm*—John E. Benoit

[57] ABSTRACT

A variable venturi carburetor for an internal combustion engine in an automobile comprising means for insulating heat transmitted from a carburetor body to a fuel well defined in a main fuel jet of the carburetor. The heat insulating means is provided at the outside of the main fuel jet as surrounding the same.

4 Claims, 9 Drawing Figures

VARIABLE VENTURI CARBURETOR

BACKGROUND OF THE INVENTION

This invention relates to a variable venturi carburetor for an internal combustion engine which may suppress fluctuation in air-fuel ratio by preventing vaporization of fuel at engine idle operation.

In recent years, as a part of development of automobiles having good fuel economy, there has been significant development of reducing fuel consumption wherein the engine is run stably with leaner air-fuel ratio at idle operation and yet with lower idling engine speeds. In a conventional variable venturi carburetor, when temperature of the carburetor body rises after running of the engine at high speeds, temperature of the main fuel jet in the carburetor body also rises and fuel temperature in the fuel well in the main fuel jet rises to create fuel vapor. The fuel vapor influences fuel metering operation at the main fuel jet or it is mixed with air/fuel mixture in the air intake passage, thus fluctuating the air-fuel ratio. Particularly, at idle engine operation at low idling speeds and with leaner air-fuel ratio, fuel combustion condition becomes unstable, and it sometimes causes engine stall.

SUMMARY OF THE INVENTION

Accordingly, it is an object of the present invention to provide a variable venturi carburetor which may prevent vaporization of fuel at idle operation and suppress fluctuation of air-fuel ratio to ensure low idling speeds with lean air-fuel mixture.

According to the present invention, the variable venturi carburetor having a carburetor body, a float chamber, a main fuel jet, and a fuel well defined in the main fuel jet comprises means for insulating heat transmitted from the carburetor body to the fuel well which means is provided at the outside of the main fuel jet as surrounding the same. With this arrangement, increase in temperature of the fuel in the fuel well may be suppressed, especially when the temperature of the carburetor body is high, thereby preventing creation of fuel vapor in the fuel well. As a result, fluctuation of air-fuel ratio at idle operation may be suppressed, thereby achieving lower idling speeds with leaner air-fuel ratio; reduced fuel consumption and simplification of the associated exhaust has purifying system.

Various general and specific objects, advantages and aspects of the invention will become apparent when reference is made to the following detailed description of the invention considered in conjunction with the related accompanying drawings.

DETAILED DESCRIPTION OF THE PREFERRED EMBODIMENTS

Figure 1:
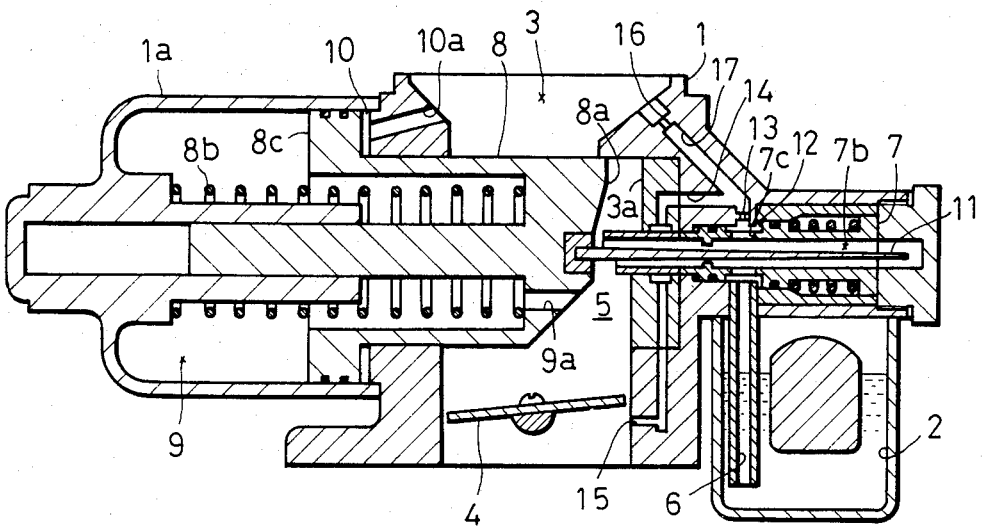
FIG. 1 is a vertical cross-sectional view of the variable venturi carburetor of a first embodiment.

Referring now to FIG. 1 which shows a variable venturi carburetor of a first embodiment according to the present invention, reference numeral 1 designates a carburetor body of a variable venturi type having a float chamber 2, an air intake passage 3, a throttle valve 4 and a venturi portion 5. Reference numeral 6 designates a fuel passage communicating with the float chamber 2 and the venturi portion 5. The fuel passage 6 is provided with a main fuel jet 7 on the way thereof. The venturi portion 5 is defined upstream of the throttle valve 4 by the inside wall 3*a* of the air intake passage 3 and the right-hand end portion 8*a* of a suction piston 8. A suction chamber 9 is defined by a cylindrical portion 1*a* of the carburetor body 1 and the suction piston 8 slidably mounted in the cylindrical portion 1*a*. A compression spring 8*b* is disposed in the suction chamber 9 and serves normally to urge the suction piston 8 toward the inside wall 3*a* of the air intake passage 3. A vacuum communication port 9*a* is provided at the right-hand end portion 8*a* of the suction piston 8 and is adapted to communicate with the suction chamber 9 and the venturi portion 5. An atmospheric pressure chamber 10 is defined by the sliding flange portion 8*c* of the suction piston 9 and the carburetor body 1 and is provided with an atmospheric pressure communication port 10*a* in the vicinity of the inlet of the air intake passage 3, whereby ambient air is induced through the port 10. A fuel metering needle 11 is fixed to the right-hand end portion 8*a* of the suction piston 8 at its central portion. The free end of the metering needle 11 projects into the interior of the main fuel jet 7 for lateral reciprocation therein. The main fuel jet 7 is formed with an opening 7*c* upstream of a jet portion 7*a*, and with a fuel well 7*b* therein. The fuel well 7*b* is communicated with a slow fuel passage 14 through the opening 7*c*, an annular chamber 12 and a slow jet 13. The slow fuel passage 14 is communicated with an idle port 15 opened to the air intake passage 3 downstream of the throttle valve 4, passing through the carburetor body 1 and the inside wall plate 3*a*. The slow jet 13 is communicated with an air bleed passage 17 leading through a bleed jet 16 to the inlet of the air intake passage 3. The slow fuel passage 14 joins the air bleed passage 17 directly downstream of the bleed jet 16.

Figure 2:
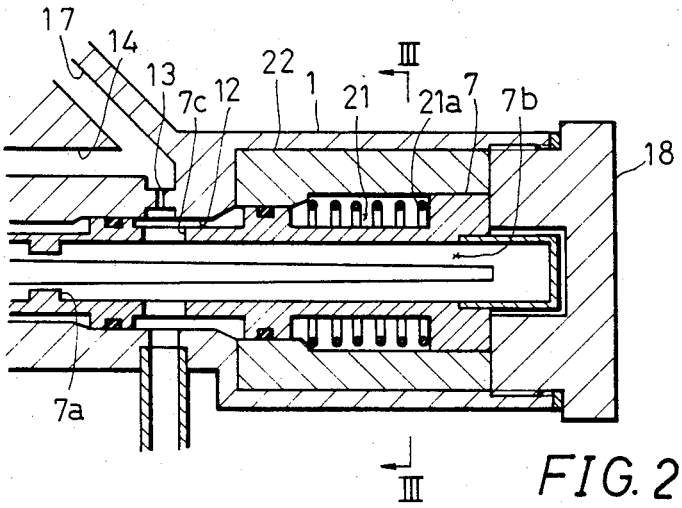
FIG. 2 is an enlarged cross section of the essential part of FIG. 1.
Figure 3:
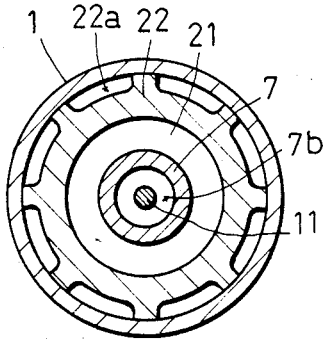
FIG. 3 is a cross section taken along the line III—III in FIG. 2.

As shown in FIG. 2, the main fuel jet 7 is provided with an annular recess extending possible maximum length longitudinally on the outer circumference thereof to define an air layer 21. A cylindrical space is defined between the main fuel jet 7 and the carburetor body 1, into which a heat insulator layer 22 is inserted for insulating heat transmitted from the carburetor body 1. As is best seen in FIG. 3, the heat insulator layer 22 is provided with a plurality of elongated grooves extending longitudinally and arranged substantialy equally spaced apart from each other on the outer circumference thereof, whereby another air layer 22*a* is defined between the heat insulator layer 21 and the carburetor body 1. The main fuel jet 7 and the heat insulator layer 22 are fixed by a fixture member 18 threaded into the carburetor body 1 at their rear end or at their right-hand end in FIG. 2. A compression spring 21*a* is inserted in the air layer 21 for rearwardly urging the main fuel jet 7 by the preload thereof. The heat insulator layer 22 is preferably made of ceramics and may be made of polyphenylsulphide resin, phenol resin and the like.

Figure 4:
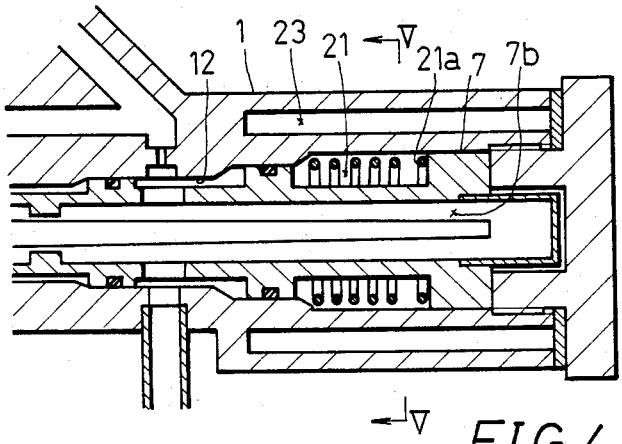
FIG. 4 is an enlarged cross section of the essential part of a second embodiment.
Figure 6:
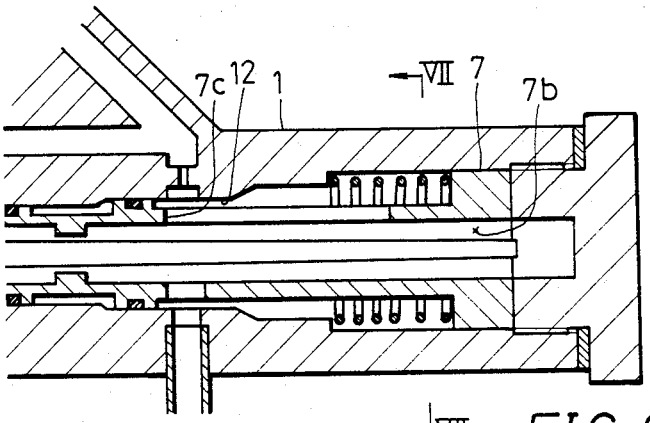
FIG. 6 is an enlarged cross section of the essential part of the variable venturi carburetor in the prior art.
Figure 7:
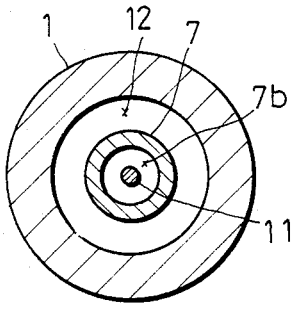
FIG. 7 is a cross section taken along the line VII—VII in FIG. 6.

As is apparent from FIGS. 2 and 4 in comparison with FIG. 6, the opening 7*c* and the annular chamber of the invention are reduced in size so as to reduce the area on which the fuel in the fuel well 7*b* contacts with the carburetor body 1.

Figure 5:
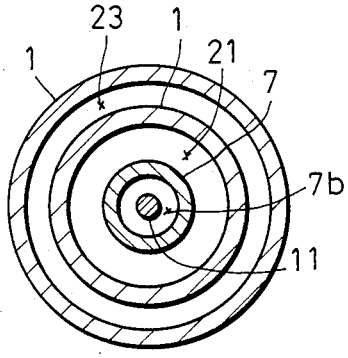
FIG. 5 is a cross section taken along the line V—V in FIG. 4.

Referring next to FIGS. 4 and 5 showing a modified embodiment of the invention, a cylindrical cavity is defined in the carburetor body 1 as surrounding the inner air layer 21, which cavity extends longitudinally along the main fuel jet 7 to define an outer air layer 23. In this embodiment, a heat insulating material is advantageously obviated.

In operation, when the engine is running at idle operation, temperature in the vicinity of the variable venturi carburetor increases and accordingly heat tends to be transmitted to the main fuel jet 7. However, the heat transfer speed may be lowered by the provision of the heat insulator layer 22 and the air layer 22*a* in the first embodiment, and by the provision of the outer air layer 23 in the second embodiment. The heat transfer speed may be further lowered by the provision of the inner air layer 21. Accordingly, the fuel temperature in the fuel well 7*b* rises more slowly until it reaches the surrounding temperature as compared with the carburetor in the prior art. As a result, fuel vapor is hardly created in the fuel well 7*b*, thereby obviating fluctuation of an air-fuel ratio and ensuring stable engine idle operation at low engine speeds and with lean air-fuel ratio even when the temperature in the vicinity of the carburetor body 1 is high.

Figure 8:
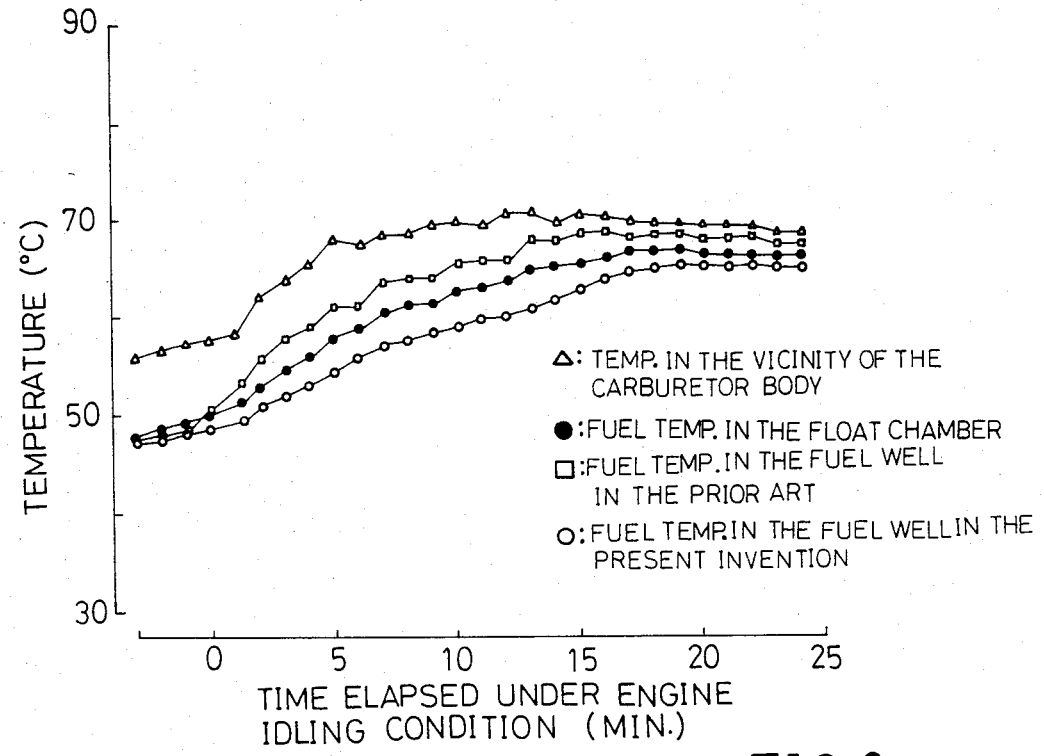
FIGS. 8 and 9 show operational characteristics of the invention as compared with the prior art.

FIG. 8 shows a change in the temperature of the surrounding of the carburetor body, the fuel temperature in the float chamber and the fuel temperature in the fuel well in the invention in comparison with the prior art at engine idle operation after running of high speeds as a function of time elapsed. As is apparent from the graph in FIG. 8, in the prior art, the fuel temperature in the fuel well is higher than that in the float chamber. On the contrary, in the present invention, it is lower than that in the float chamber due to the effect of the provision of the heat insulator. The fuel temperature in the fuel well in the prior art reaches a peak level after about thirteen minutes are elapsed under the engine idle condition. On the contrary, in the present invention, it reaches a peak level after about nineteen minutes are elapsed.

Figure 9:
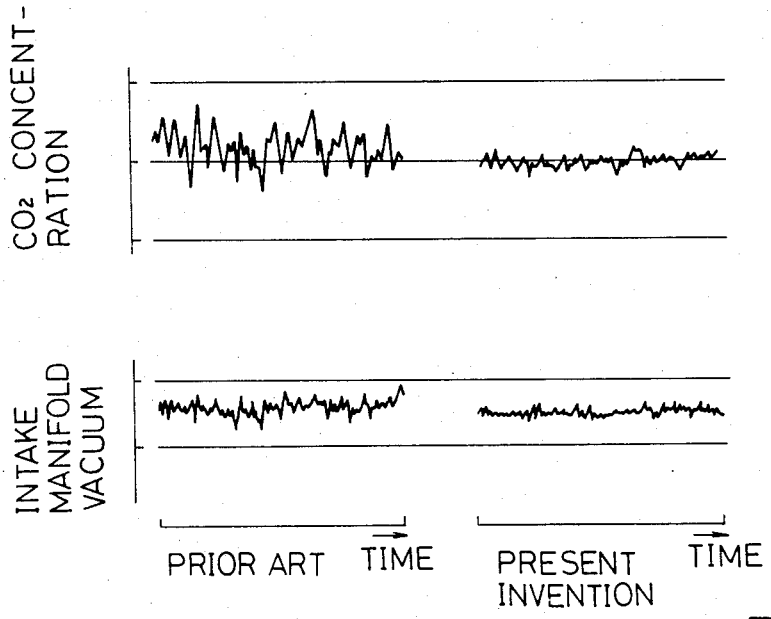

FIG. 9 shows fluctuations of $CO_2$ concentration and intake manifold vacuum after about ten minutes are elapsed under the engine idle condition where they are likely to become most unstable. The fluctuations in the invention are reduced more than those in the prior art.

Having thus described the preferred embodiment of the invention it should be understood that numerous structural modifications and adaptations may be restored to without departing from the spirit of the invention.

What is claimed is:

1. In combination with a variable venturi carburetor for an internal combustion engine in an automobile having a carburetor body, a float chamber, an air intake passage, a venturi portion provided in said air intake passage, a fuel passage communicating with said float chamber and said venturi portion, a main fuel jet provided in said fuel passage, a suction piston transversely movable with respect to said venturi portion in response to the load conditions of the engine and adapted to be slidably mounted in a cylindrical portion of said carburetor body, a fuel metering needle fixed at its base for controlling the annular opening area of a fuel metering portion of said main fuel jet by reciprocating motion of said suction piston and a fuel well defined in said main fuel jet; the improvement comprising an air layer for insulating heat transmitted from said carburetor body to said fuel well and extending continuously uninterrupted longitudinally on the outer circumference of said main fuel jet and a heat insulator layer surrounding said air layer and extending continuously uninterrupted around said air layer.

2. The variable venturi carburetor as defined in claim 1, wherein said heat insulator layer is provided with a plurality of elongated grooves extending longitudinally and arranged substantially equally spaced apart from each other on the outer circumference thereof.

3. The variable venturi carburetor as defined in claim 1, wherein said heat insulator layer is made of the material selected from the group consisting of ceramics, polyphenylsulphide resin and phenol resin.

4. The variable venturi carburetor as defined in claim 1, wherein said heat insulating means comprises a first air layer extending longitudinally on the outer circumference of said main fuel jet and a second air layer defined in said carburetor body as surrounding said first air layer.

* * * * *